US006401425B1

(12) United States Patent
Frame

(10) Patent No.: US 6,401,425 B1
(45) **Date of Patent: *Jun. 11, 2002**

(54) METHOD OF INSTALLING ROOFING SHINGLES

(76) Inventor: Craig Frame, 1542 Sierra Alta, Santa Ana, CA (US) 92705

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/377,321

(22) Filed: Aug. 19, 1999

(51) Int. Cl.[7] ..... E04D 1/00
(52) U.S. Cl. ..... 52/748.1; 52/518
(58) Field of Search ..... 52/518, 520, 748.1

(56) References Cited

U.S. PATENT DOCUMENTS

| | | | |
|---|---|---|---|
| 3,998,685 | A | 12/1976 | Czyzewski et al. |
| D247,786 | S | 4/1978 | Flood |
| 4,266,388 | A | 5/1981 | Flood |
| 4,729,814 | A | 3/1988 | Jennus et al. |
| 4,775,440 | A | 10/1988 | Jennus et al. |
| 4,869,942 | A | 9/1989 | Jennus et al. |
| 5,052,162 | A | 10/1991 | Bush et al. |

OTHER PUBLICATIONS

Celotex, Residential Roofing Technical Bulletin, dated Jan. 1998, No. 771a, Dual Color Application Methods.

Celotex, Residential Roofing Technical Bulletin, dated Jan. 1998, No. 769a, Directions for Applications.

*Primary Examiner*—Robert W. Gibson, Jr.
(74) *Attorney, Agent, or Firm*—Knobbe, Martens, Olson and Bear

(57) ABSTRACT

A method of installing differently colored roofing shingles to create the appearance of a substantially random colored pattern. The method includes the selection of at least two colors of roofing shingles. The shingles are installed in a plurality of rows on a roofing substrate in a repetitive pattern. Advantageously, the method creates a visually aesthetic roof at a desirably low cost.

18 Claims, 5 Drawing Sheets

METHOD OF INSTALLING ROOFING SHINGLES

BACKGROUND OF THE INVENTION

1. Field of the Invention

The present invention relates to the field of roofing shingles, and, in particular, to a method of installing differently colored roofing shingles to achieve the appearance of a randomly colored pattern.

2. Background of the Related Art

Nowadays, it is very popular to use differently colored shingles as a roofing material. In many cases, these shingles are arranged in a pre-determined color based format which results in the creation of a substantially distinct and ordered color pattern. Though this process is relatively simple and expeditious, the appearance of a distinct and ordered color pattern on a roof can be aesthetically displeasing and, hence, undesirable.

Alternatively, differently colored shingles may be individually selected and arranged in a random format to achieve the appearance of a substantially random color pattern. Those of ordinary skill in the art will readily recognize that, disadvantageously, this can be a very time consuming process. As a result, the cost of labor and craftsmanship associated with employing such a time consuming method can be undesirably high.

Thus, there is a need for a simple and expeditious method of installing differently colored roofing shingles to create the appearance of a substantially random color pattern, thereby creating a visually aesthetic roof at a desirably low cost.

SUMMARY OF THE INVENTION

A method of installing roofing shingles in accordance with the present invention overcomes the above-mentioned disadvantages by incorporating a conventional shingle installation format in conjunction with a substantially simple row-based color selection scheme. Preferably, the method is used in installing roofing material which is substantially the same as Celotex Presidential® roofing shingles and includes the selection of at least two colors of roofing shingles. The shingles are preferably installed in a plurality of rows on a roofing substrate in a repetitive pattern that provides the appearance, when installed, of a substantially random pattern of at least two colors.

In a first preferred embodiment of the method of the present invention, two colors of roofing shingles are selected. A first row of shingles, comprising substantially only the first of the two colors, is installed on the roofing substrate. A second row of shingles is installed adjacent to the first row, in a conventional installation format, and comprises substantially only the second of the two colors. A third row of shingles is installed adjacent to the second row, in a conventional installation format, wherein the third row is a substantially periodic alternating pattern of the two colors. The shingle installation sequence for the first three rows is generally repeated for the subsequent rows.

In a second preferred embodiment of the method of the present invention, two colors of roofing shingles are selected. A first row of shingles, comprising substantially only the first of the two colors, is installed on the roofing substrate. A second row of shingles is installed adjacent to the first row, in a conventional installation format, wherein the second row is a substantially periodic alternating pattern of the two colors. A third row of shingles is installed adjacent to the second row, in a conventional installation format, and comprises substantially only the second of the two colors. A fourth row of shingles is installed adjacent to the third row, in a conventional installation format, wherein the fourth row is a substantially periodic alternating pattern of the two colors. The shingle installation sequence for the first four rows is generally repeated for the subsequent rows.

In a third preferred embodiment of the method of the present invention, three colors of roofing shingles are selected. A first row of shingles, comprising substantially only the first of the three colors, is installed on the roofing substrate. A second row of shingles is installed adjacent to the first row, in a conventional installation format, wherein the second row is a substantially periodic alternating pattern of at least two of the three colors. A third row of shingles is installed adjacent to the second row, in a conventional installation format, and comprises substantially only the second of the three colors. A fourth row of shingles is installed adjacent to the third row, in a conventional installation format, wherein the fourth row is a substantially periodic alternating pattern of at least two of the three colors. A fifth row of shingles is installed adjacent to the fourth row, in a conventional installation format, and comprises substantially only the third of the three colors. A sixth row of shingles is installed adjacent to the fifth row, in a conventional installation format, wherein the sixth row is a substantially periodic alternating pattern of at least two of the three colors. The shingle installation sequence for the first six rows is generally repeated for the subsequent rows.

Those of ordinary skill in the art will readily recognize the utility of the present invention. Advantageously, the roofing shingle installation method of the present invention creates the appearance of a substantially random color pattern, thereby creating a visually aesthetic roof at a desirably low cost.

Other specific provisions and advantages of the present invention will become apparent from a reading and study of the specification, claims and figures. As will be realized by those skilled in the art the invention is capable of modifications in various respects, all without departing from the scope and utility of the invention as disclosed herein. Accordingly the specification and figures should be regarded as illustrative in nature, and not as restrictive

DETAILED DESCRIPTION OF THE PREFERRED EMBODIMENTS

Figure 1:
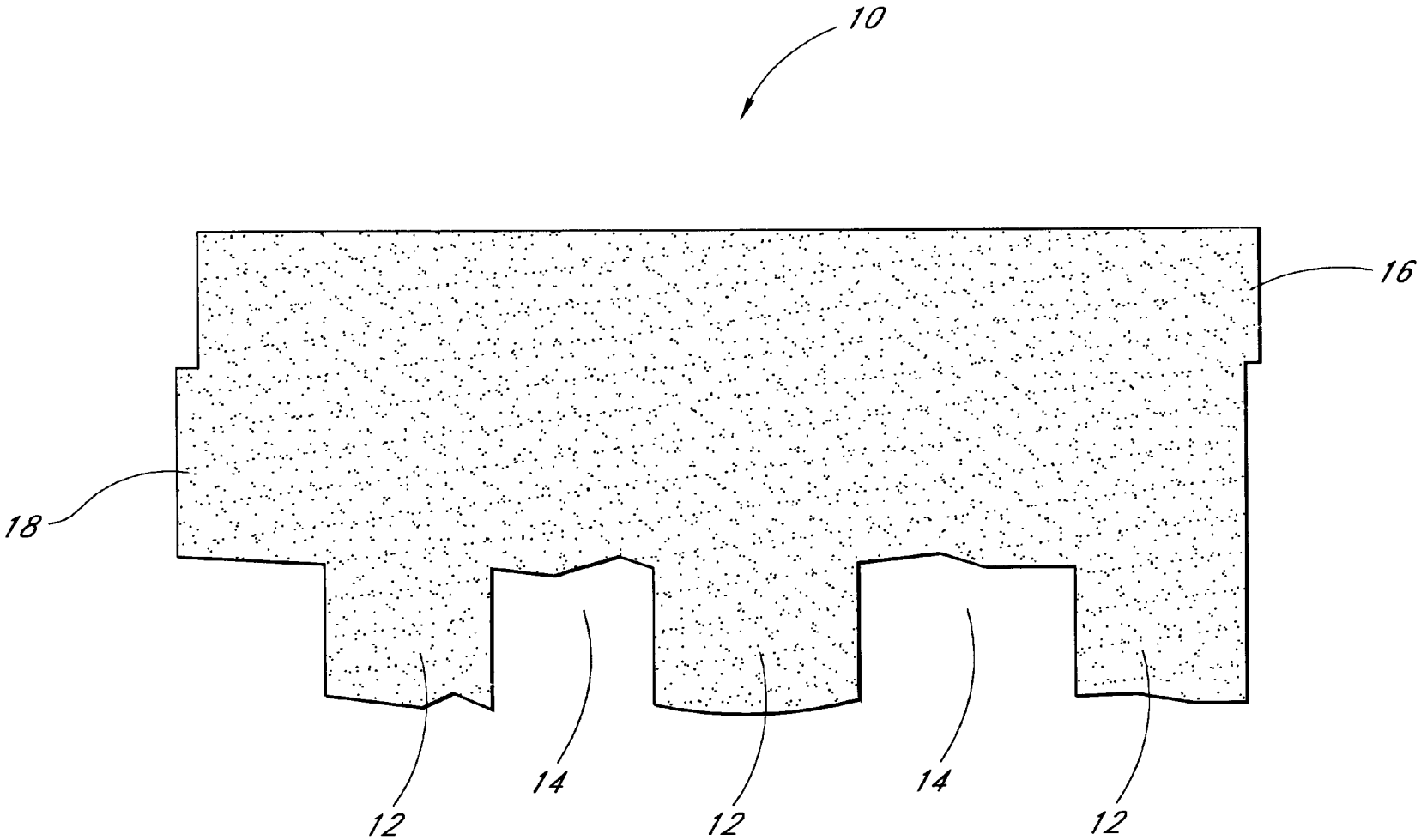
FIG. 1 illustrates a roofing shingle similar to a typical Celotex Presidential® roofing shingle;, FIG. 2 schematically illustrates a substantially random looking color pattern formed by differently colored shingles in accordance with a first preferred embodiment of the method of the present invention.

The method of the present invention is used to install a roofing material which is substantially the same as Celotex Presidential® shingles. FIG. 1 illustrates a typical Celotex Presidential® shingle 10 having a generally rectangular shape with a plurality of teeth 12 and a plurality of slots 14. Although FIG. 1 depicts three "teeth," such shingles may have four or more "teeth" as well. These teeth are the significant feature of the shingles used in connection with the present invention to permit the desired effect. The shingle 10 may have a pair of spaced tabs 16 and 18 which facilitate in positioning the shingles in rows.

Figure 2:
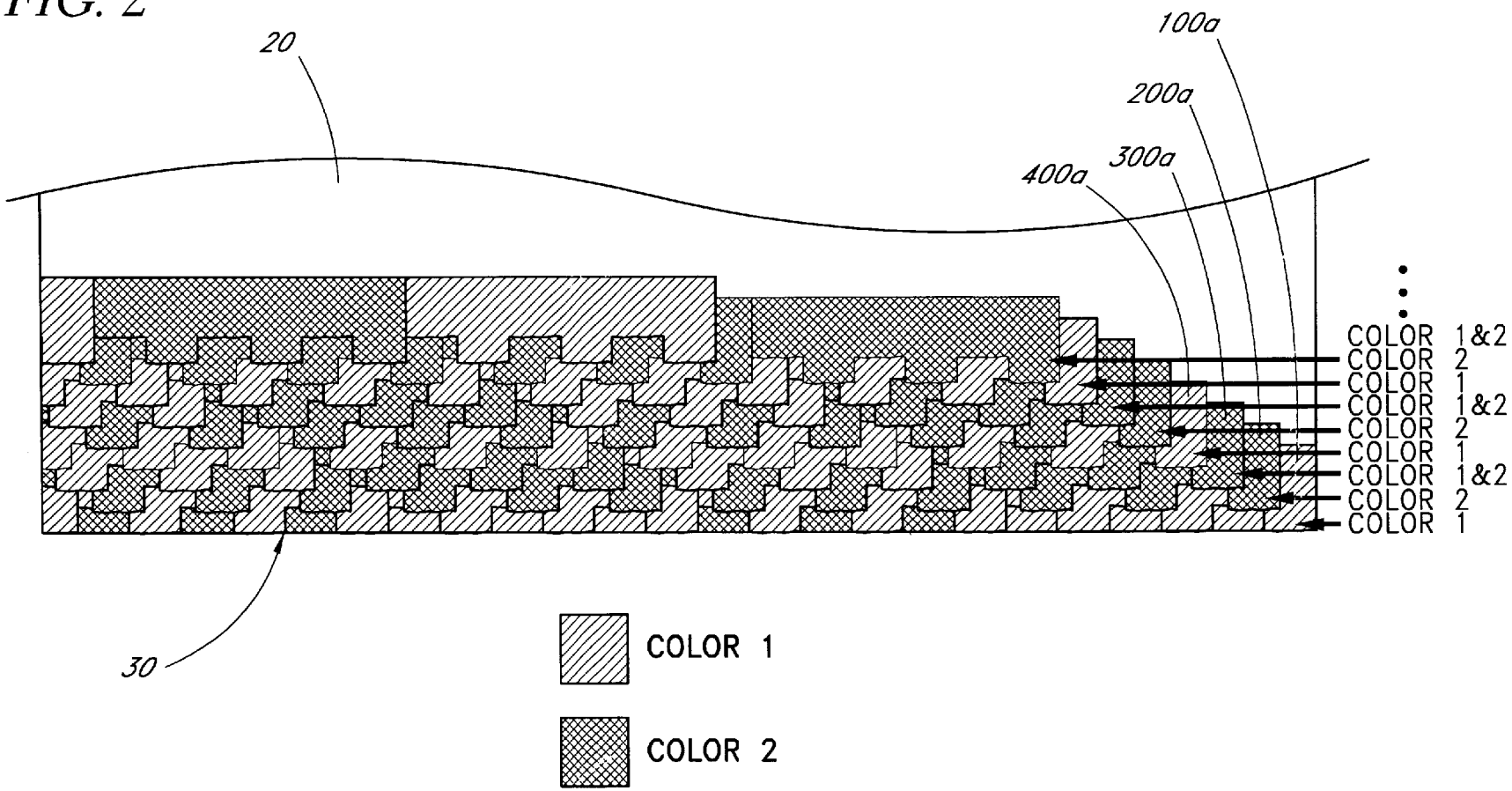
Figure 3:
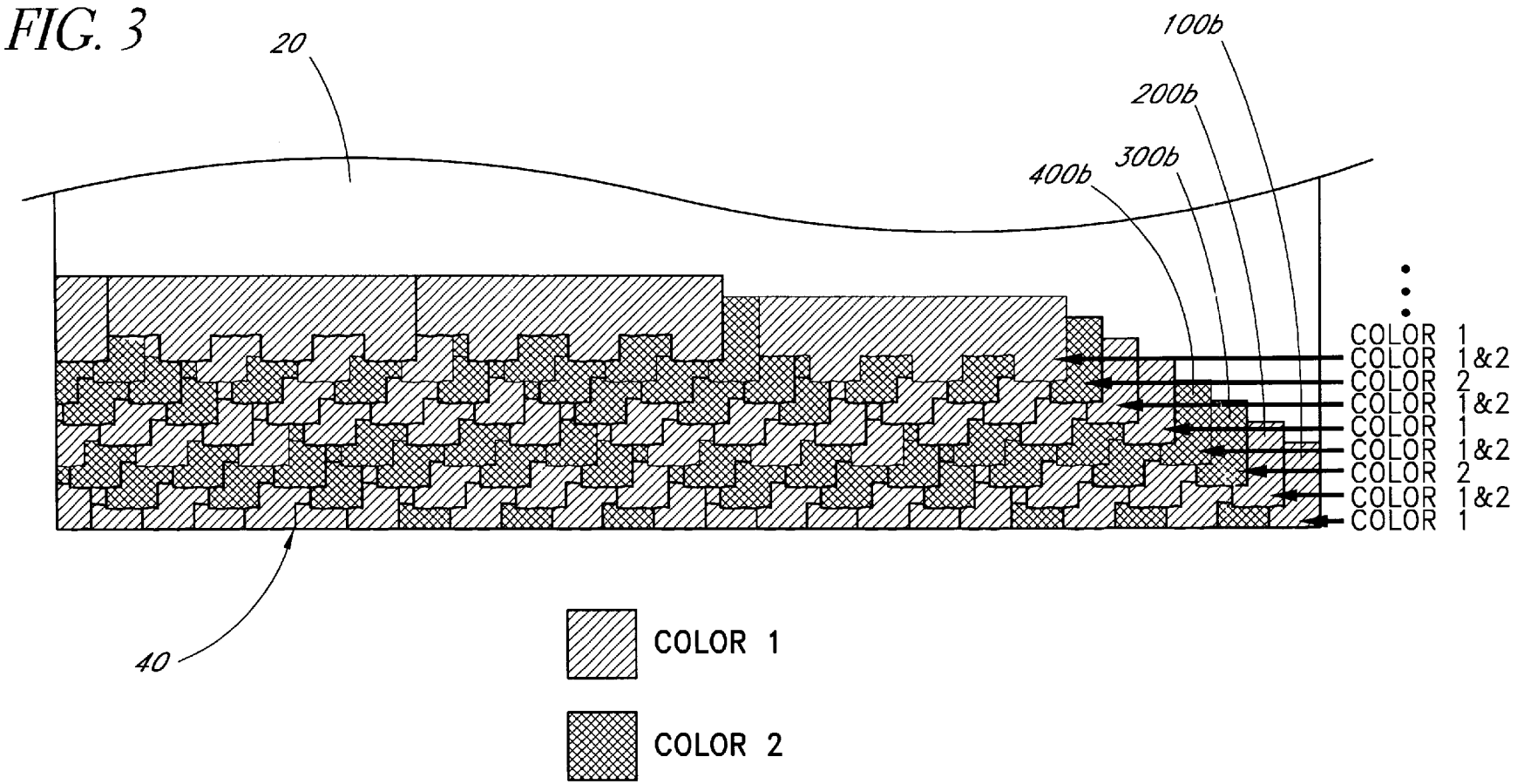
FIG. 3 schematically illustrates a substantially random looking color pattern formed by differently colored shingles in accordance with a second preferred embodiment of the method of present invention.
Figure 4A:
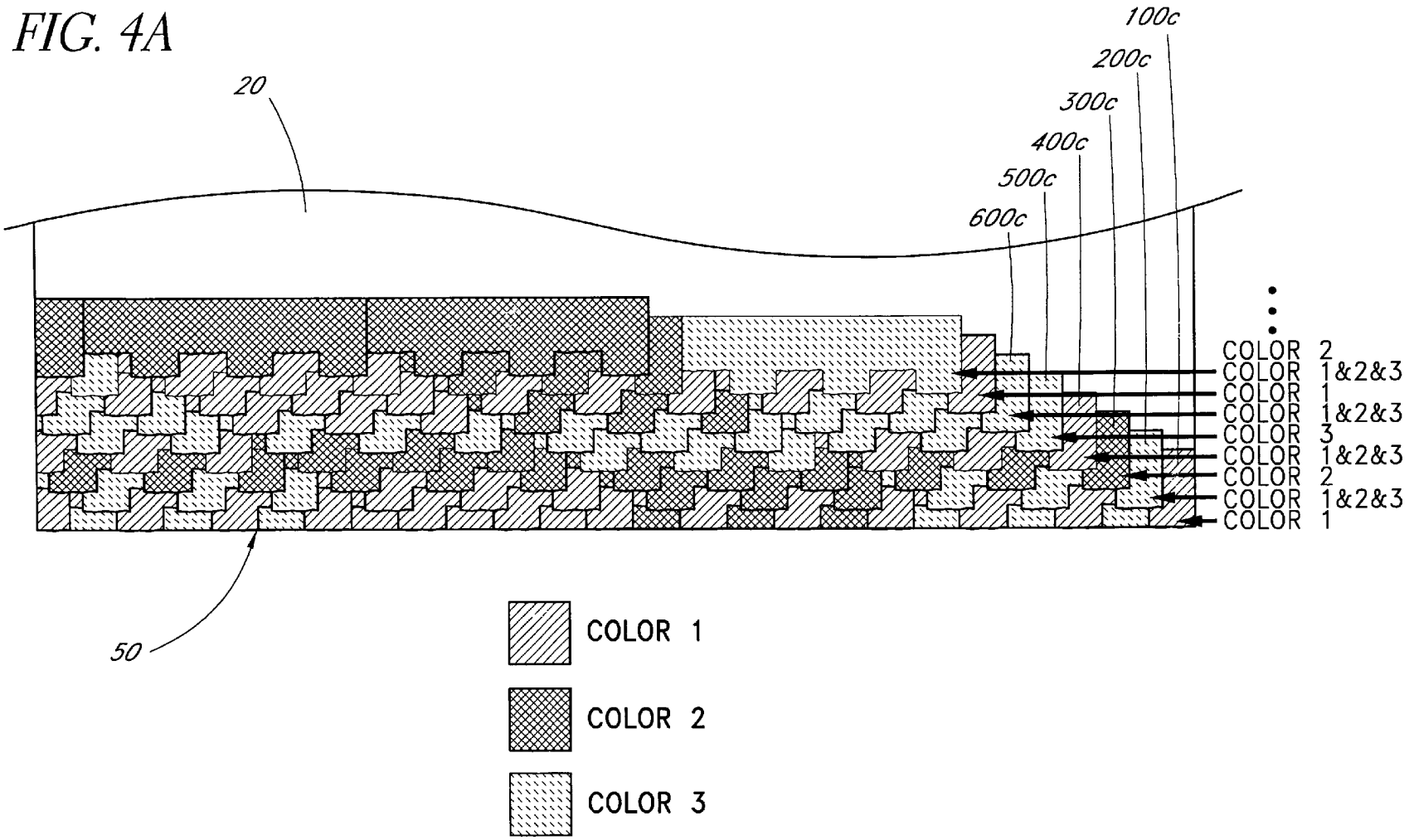
FIG. 4A schematically illustrates a substantially random looking color pattern formed by differently colored shingles in accordance with a third preferred embodiment of the method of the present invention.
Figure 4B:
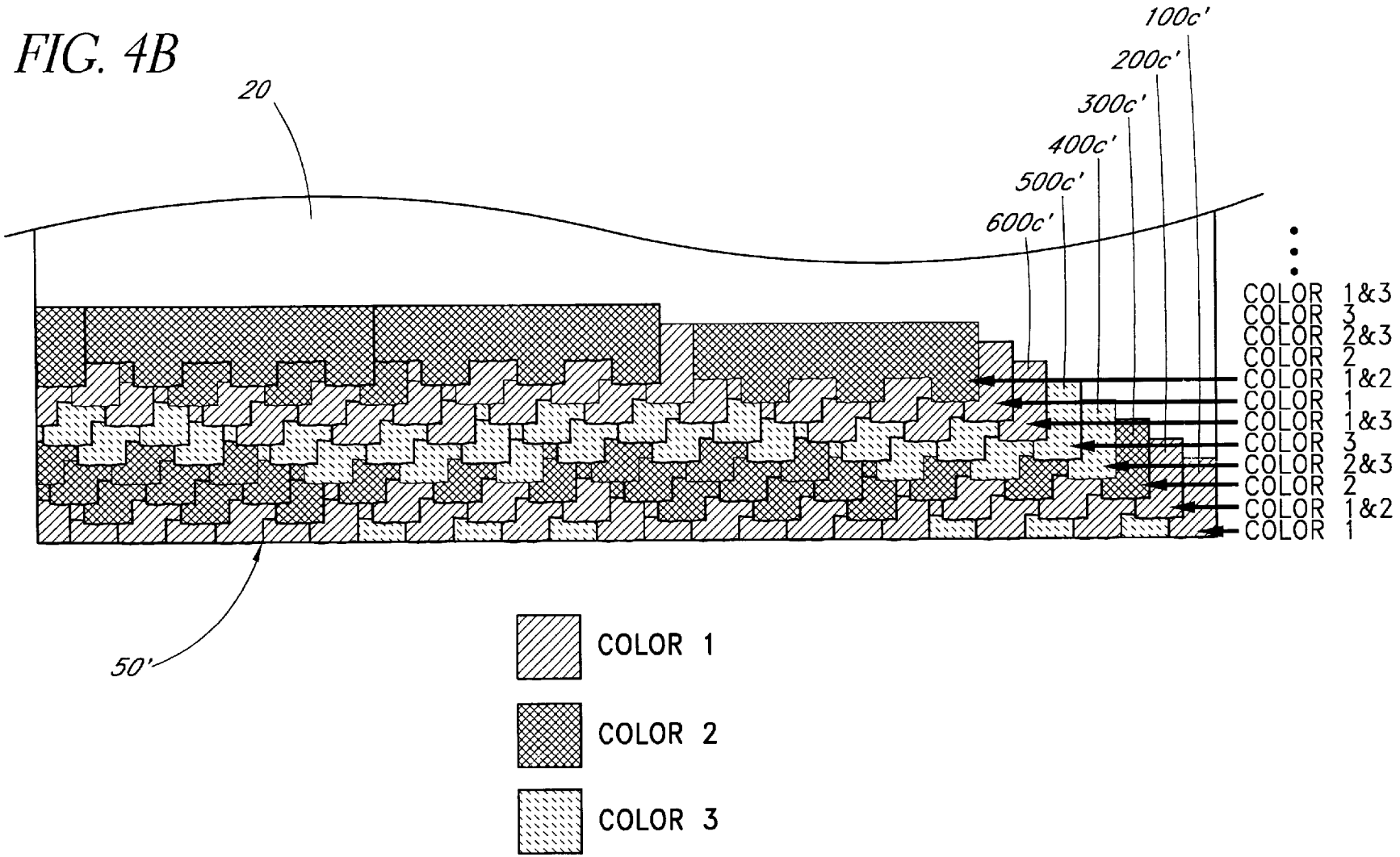
FIG. 4B schematically illustrates a substantially random looking color pattern formed by differently colored shingles in accordance with another preferred third embodiment of the method of the present invention.

The method of the present invention includes the selection of at least two colors of roofing shingles 10, for example, colors 1, 2, 3 as shown in FIGS. 2, 3, 4A and 4B. The shingles 10 are installed in a plurality of rows on a roofing substrate 20 (shown schematically in FIGS. 2, 3, 4A and 4B). The installation follows a repetitive pattern that provides the appearance, when the shingles 10 are installed, of a substantially random colored pattern, such as the patterns 30 (FIG. 2), 40 (FIG. 3), 50 (FIG. 4A) and 50' (FIG. 4B). The method of the present invention may be practiced in a wide variety of combinations, though a few preferred embodiments are discussed in greater detail herein below.

First Preferred Embodiment

In a first preferred embodiment of the method of the present invention, illustrated in FIG. 2, two colors 1 and 2 of roofing shingles 10 are selected. A first row 100*a* of shingles 10 is installed on the roofing substrate 20; the first row 100*a* comprises shingles 10 of substantially only the color 1. A second row 200*a* of shingles 10 is installed adjacent to the first row 100*a,* in a conventional installation format, and comprises substantially only the shingles 10 of the color 2. Those skilled in the art will be aware that the conventional installation format referred to typically involves installing shingles 10 of row 200*a* overlappingly adjacent to row 100*a* and offset with respect to the shingles 10 of the row 100*a*. Of course, shingles 10 at the edges of the roofing substrate 20 may require trimming to define a generally smooth boundary, as is well known in the art. A third row 300*a* of shingles 10 is installed adjacent to the second row 200*a,* in a conventional installation format, wherein the third row 300*a* is a substantially periodic alternating pattern of the colors 1 and 2. Preferably, the shingles 10 of the third row 300*a* are installed by alternating one shingle of color 1 with one shingle of color 2, as is illustrated in FIG. 2, though other substantially periodic alternating patterns of the colors 1 and 2 may be employed with efficacy. Alternatively, the shingles 10 of row 300*a* may be arranged in a substantially random pattern of colors 1 and 2.

Preferably, the shingle installation sequence for the first three rows 100*a,* 200*a,* 300*a* is generally repeated for the subsequent corresponding rows, as is illustrated in FIG. 2, to create a pattern 30 that provides the appearance of a substantially random pattern 30 of the colors 1 and 2. Alternatively, the scope of the present invention permits that the subsequent rows corresponding to the third row 300*a* may be patterned in a variety of substantially periodic alternating or random patterns of the colors 1 and 2 which may differ not only from one another but also from the pattern of the third row 300*a*.

Second Preferred Embodiment

In a second preferred embodiment of the method of the present invention, illustrated in FIG. 3, two colors 1 and 2 of roofing shingles 10 are selected. A first row 100*b* of shingles 10 is installed on the roofing substrate 20; the first row 100*b* comprises shingles 10 of substantially only the color 1. A second row 200*b* of shingles 10 is installed adjacent to the first row 100*b,* in a conventional installation format, wherein the second row 200*b* is a substantially periodic alternating pattern of the colors 1 and 2. A third row 300*b* of shingles 10 is installed adjacent to the second row 200*b,* in a conventional installation format, and comprises substantially only the shingles 10 of the color 2. A fourth row 400*b* of shingles 10 is installed adjacent to the third row 300*b,* in a conventional installation format, wherein the fourth row 400*b* is a substantially periodic alternating pattern of the colors 1 and 2.

Preferably, the shingles 10 of the second row 200*b* and the fourth row 400*b* are installed by alternating one shingle of color 1 with one shingle of color 2, as is illustrated in FIG. 3, though other substantially periodic alternating patterns of the colors 1 and 2 may be employed with efficacy. Alternatively, the shingles 10 of the row 200*b* and/or the row 400*b* may be arranged in a substantially random pattern of colors 1 and 2.

Preferably, the shingle installation sequence for the first four rows 100*b,* 200*b,* 300*b,* 400*b* is generally repeated for the subsequent corresponding rows, as is illustrated in FIG. 3, to create a pattern 40 that provides the appearance of a substantially random pattern 40 of the colors 1 and 2. Alternatively, the scope of the present invention permits that the subsequent rows corresponding to the second row 200*b* and to the fourth row 400*b* may be patterned in a variety of substantially periodic alternating or random patterns of the colors 1 and 2 which may differ not only from one another but also from the respective patterns of the second row 200*b* and of the fourth row 400*b*.

Third Preferred Embodiment

In a third preferred embodiment of the method of the present invention, illustrated in FIGS. 4A and 4B with each figure illustrating one preferred form of the third embodiment, three colors 1, 2 and 3 of roofing shingles 10 are selected. Referring to FIG. 4A (or FIG. 4B, with like numbers), a first row 100*c* of shingles 10 is installed on the roofing substrate 20; the first row 100*c* comprises shingles 10 of substantially only the color 1. A second row 200*c* of shingles 10 is installed adjacent to the first row 100*c,* in a conventional installation format, wherein the second row 200*c* is a substantially periodic alternating pattern of at least two of the colors 1, 2 and 3. A third row 300*c* of shingles 10 is installed adjacent to the second row 200*c,* in a conventional installation format, and comprises substantially only the shingles 10 of the color 2. A fourth row 400*c* of shingles 10 is installed adjacent to the third row 300*c,* in a conventional installation format, wherein the fourth row 400*c* is a substantially periodic alternating pattern of at least two of the colors 1, 2 and 3. A fifth row 500*c* of shingles 10 is installed adjacent to the fourth row 400*c,* in a conventional installation format, and comprises substantially only the shingles 10 of the color 3. A sixth row 600*c* of shingles 10 is installed adjacent to the fifth row 500*c,* in a conventional installation format, wherein the sixth row 600*c* is a substantially periodic alternating pattern of at least two of the colors 1, 2 and 3.

In one preferred form of the third embodiment of the present invention, as illustrated in FIG. 4A, all three colors 1, 2, 3 of shingles 10 are used in each one of the rows 200*c,* 400*c,* 600*c*. Preferably, the shingles 10 of the second row 200*c,* fourth row 400*c* and sixth row 600*c* are installed by alternating a set of three shingles 10 formed by a shingle of color 1, a shingle of color 2 and a shingle of color 3, arranged in that order, as can be seen in FIG. 4B.

In another preferred form of the third embodiment of the present invention, as illustrated in FIG. 4B, only two of the three colors 1, 2, 3 of shingles 10 are used in each one of the rows 200*c*, 400*c*, 600*c*. Preferably, the shingles 10 of the second row 200*c* are installed by alternating one shingle of color 1 with one shingle of color 2, the shingles 10 of the fourth row 400*c* are installed by alternating one shingle of color 2 with one shingle of color 3, and the shingles 10 of the sixth row 600*c* are installed by alternating one shingle of color 3 with one shingle of color 1, as can be seen in FIG. 4B.

Though FIGS. 4A and 4B each illustrate a particular preferred periodic alternating pattern of at least two of the three colors 1, 2 and 3, as installed in the multi-colored rows 200*c*, 400*c*, 600*c* of the pattern 50 (FIG. 4A) and the multi-colored rows 200*c*', 400*c*', 600*c*' of the pattern 50' (FIG. 4B), other substantially periodic alternating patterns of at least two of the three colors 1, 2 and 3 may be employed with efficacy in installation of the above-mentioned multi-colored rows. Alternatively, the shingles 10 of one or more of the above-mentioned multi-colored rows may be arranged in a substantially random pattern of at least two of the three colors 1, 2 and 3.

Preferably, the shingle installation sequence for the first six rows 100*c*, 200*c*, 300*c*, 400*c*, 500*c*, 600*c* of FIG. 4A is generally repeated for the subsequent corresponding rows, as is illustrated in FIG. 4A, to create a pattern 50 that provides the appearance of a substantially random pattern 50 of the colors 1, 2 and 3. Alternatively, the scope of the present invention permits that the subsequent rows corresponding to the second row 200*c*, the fourth row 400*c* and the sixth row 600*c* may be patterned in a variety of substantially periodic alternating or substantially random patterns of at least two of the three colors 1, 2 and 3 which may differ not only from one another but also from the respective patterns of the second row 200*c*, the fourth row 400*c* and the sixth row 600*c*.

Similarly, preferably, the shingle installation sequence for the first six rows 100*c*', 200*c*', 300*c*', 400*c*', 500*c*', 600*c*' of FIG. 4B is generally repeated for the subsequent corresponding rows, as is illustrated in FIG. 4B, to create a pattern 50' that provides the appearance of a substantially random pattern 50' of the colors 1, 2 and 3. Alternatively, the scope of the present invention permits that the subsequent rows corresponding to the second row 200*c*', the fourth row 400*c*' and the sixth row 600*c*' may be patterned in a variety of substantially periodic alternating or substantially random patterns of at least two of the three colors 1, 2 and 3 which may differ not only from one another but also from the respective patterns of the second row 200*c*', the fourth row 400*c*' and the sixth row 600*c*'.

The utility of the present invention will be readily apparent to those skilled in the art. Advantageously, the roofing shingle installation method of the present invention creates the appearance of a substantially random color pattern, thereby creating a visually aesthetic roof at a desirably low cost.

While the method of the present invention has been described with a certain degree of particularity, it is manifest that many changes may be made in the specific methodology, designs and constructions hereinabove described without departing from the spirit and scope of this disclosure. It is understood that the invention is not limited to the embodiments set forth herein for purposes of exemplification, but is to be defined only by a fair reading of the appended claims, including the full range of equivalency to which each element thereof is entitled.

What is claimed is:

1. A method of installing roofing shingles having a plurality of spaced teeth, said method comprising the steps of:

selecting at least two colors of said roofing shingles; and installing said shingles in a plurality of rows on a roofing substrate in a repetitive pattern that provides the appearance, when installed, of a substantially random pattern of said at least two colors.

2. The method of claim 1, wherein said step of installing a third row adjacent to said second row comprises alternating one shingle of said first color with one shingle of said second color.

3. The method of claim 1, wherein said step of installing comprises the steps of:

installing a first row comprising substantially only a first of said at least two colors;

installing a second row adjacent to said first row, wherein said second row is a substantially periodic alternating pattern of said at least colors;

installing a third row adjacent to said second row, comprising substantially only a second of said at least two colors; and installing a fourth row adjacent to said third row, wherein said fourth row is a substantially periodic alternating pattern of said at least colors.

4. The method of claim 3, wherein said step of installing a second row adjacent to said first row comprises alternating one shingle of said first color with one shingle of said second color.

5. The method of claim 3, wherein said step of installing a fourth row adjacent to said third row comprises alternating one shingle of said first color with one shingle of said second color.

6. The method of claim 1, wherein three colors are selected, said step of installing,comprising the steps of:

installing a first row comprising substantially only a first of said at least two colors;

installing a second row adjacent to said first row, but wherein said second row is a substantially periodic alternating pattern of at least two of said three colors;

installing a third row adjacent to said second row, comprising substantially only a second of said at least two colors installing a fourth row adjacent to said third row, but wherein said fourth row is a substantially periodic alternating pattern of at least two of said three colors;

installing a fifth row adjacent to said fourth row, comprising substantially only a third of said at least two colors; and installing a sixth row adjacent to said fifth row, but wherein said sixth row is a substantially periodic alternating pattern of at least two of said three colors.

7. The method of claim 6, wherein said step of installing a second row adjacent to said first row comprises alternating an ordered set of one shingle of said first color, one shingle of said second color, and one shingle of said third color arranged in that order.

8. The method of claim 6, wherein said step of installing a fourth row adjacent to said second row comprises alternating an ordered set of one shingle of said first color, one shingle of said second color, and one shingle of said third color arranged in that order.

9. The method of clam 6, wherein said step of installing a sixth row adjacent to said fifth row comprises alternating an ordered set of one shingle of said first color, one shingle of said second color, and one shingle of said third color arranged in that order.

10. The method of claim 6, wherein said step of installing a second row adjacent to said first row comprises alternating one shingle of said first color with one shingle of said second color.

11. The method of claim 6, wherein said step of installing a fourth row adjacent to said third row comprises alternating one shingle of said second color with one shingle of said third color.

12. The method of claim 6, wherein said step of installing a sixth row adjacent to said fifth row comprises alternating one shingle of said third color with one shingle of said first color.

13. A roofing system comprising a plurality of roofing shingles selected from at least two groups of roofing shingles, said first group having substantially the same first color, and said second group having substantially the same second color different from said first color, said plurality of roofing shingles being arranged in a plurality of rows comprising:

at least a first row of shingles wherein substantially all of the shingles in said first row are from said first group;

at least a second row of shingles adjacent said first row, wherein substantially all of the shingles in said second row are from said second group;

at least a third row of shingles adjacent said second row, wherein substantially all of the shingles in said third row are selected from both said first and second groups of shingles, and the shingles are arranged in a substantially periodic alternating pattern of said first group of shingles and said second group of shingles.

14. A roofing system comprising an ordered repeating block sequence of shingles, said ordered repeating block sequence having a length and a height and comprising at least a first color of shingles and a second color of shingles, said ordered repeating block sequence comprising a first row of shingles, a second row of shingles and a third row of shingles arranged in seriatim, at least one of said first row, said second row and said third row comprising a generally repeating strip pattern of said first color of shingles and said second color of shingles across said length of said ordered repeating block sequence, the remaining two rows of said first row, said second row and said third row comprising strips of said first color and said second color respectively extending across said length of said ordered repeating block such that, when said ordered repeating block sequence is arranged next to another substantially duplicate ordered repeating block sequence of shingles, said roofing system appears to be random.

15. The roofing system of claim 14, wherein said strip of said first color consists of only shingles of said first color.

16. The roofing system of claim 14, wherein said generally repeating strip pattern of said first color of shingles and said second color of shingles consists of alternating said first color of shingles and said second color of shingles across said length of said ordered repeating block sequence.

17. The roofing system of claim 14, wherein said length and said height of said ordered repeating block sequence is less than a length and a height of a receiving substrate.

18. The roofing system of claim 14 further comprising a fourth row of shingles, wherein said fourth row also is a generally repeating strip pattern of said first color of shingles and said second color of shingles across said length of said ordered repeating block sequence and the two generally repeating strip pattern rows and interposed between said remaining two rows that comprises strips of said first color and said second color respectively.

* * * * *

UNITED STATES PATENT AND TRADEMARK OFFICE

CERTIFICATE OF CORRECTION

PATENT NO. : 6,401,425 B1
APPLICATION NO. : 09/377321
DATED : June 11, 2002
INVENTOR(S) : Craig Frame It is certified that error appears in the above-identified patent and that said Letters Patent is hereby corrected as shown below:

At column 6, line 5, after the word "colors," please insert:

-- wherein installing comprises the steps of:

installing a first row comprising substantially only a first of said at least two colors;

installing a second row adjacent to said first row, comprising substantially only a second of said at least two colors; and installing a third row adjacent said second row, wherein said third row is a substantially periodic alternating pattern of said at least colors. --

At column 6, please delete claims 3 and 6 in their entirety and replace with claims 3 and 6 as amended November 27, 2001:

-- 3. A method of installing roofing shingles having a plurality of spaced teeth, said method comprising the steps of:

selecting at least two colors of said roofing shingles; and installing said shingles in a plurality of rows on a roofing substrate in a repetitive pattern that provides the appearance, when installed, of a substantially random pattern of said at least two colors, wherein said step of installing comprises the steps of:

installing a first row comprising substantially only a first of said at least two colors;

installing a second row adjacent to said first row, wherein said second row is a substantially periodic alternating pattern of said at least colors;

installing a third row adjacent to said second row, comprising substantially only a second of said at least two colors; and installing a fourth row adjacent to said third row, wherein said fourth row is a substantially periodic alternating pattern of said at least colors.

UNITED STATES PATENT AND TRADEMARK OFFICE

CERTIFICATE OF CORRECTION

PATENT NO. : 6,401,425 B1
APPLICATION NO. : 09/377321
DATED : June 11, 2002
INVENTOR(S) : Craig Frame It is certified that error appears in the above-identified patent and that said Letters Patent is hereby corrected as shown below:

-- 6. A method of installing roofing shingles having a plurality of spaced teeth, said method comprising the steps of:

selecting at least two colors of said roofing shingles; and installing said shingles in a plurality of rows on a roofing substrate in a repetitive pattern that provides the appearance, when installed, of a substantially random pattern of said at least two colors, wherein three colors are selected, said step of installing comprising the steps of:

installing a first row comprising substantially only a first of said at least two colors;

installing a second row adjacent to said first row, but wherein said second row is a substantially periodic alternating pattern of at least two of said three colors;

installing a third row adjacent to said second row, comprising substantially only a second of said at least two colors installing a fourth row adjacent to said third row, but wherein said fourth row is a substantially periodic alternating pattern of at least two of said three colors;

installing a fifth row adjacent to said fourth row, comprising substantially only a third of said at least two colors; and installing a sixth row adjacent to said fifth row, but wherein said sixth row is a substantially periodic alternating pattern of at least two of said three colors.

Signed and Sealed this

Twenty-fourth Day of October, 2006

JON W. DUDAS
*Director of the United States Patent and Trademark Office*